US008910707B2

(12) United States Patent
Klimack et al.

(10) Patent No.: US 8,910,707 B2
(45) Date of Patent: Dec. 16, 2014

(54) CEMENT HEAD

(75) Inventors: Brian K. Klimack, Tofield (CA); Jesse Klimack, Edmonton (CA); Edmond Fouillard, Thorsby (CA)

(73) Assignee: Klimack Holdings Inc., Edmonton (CA)

( * ) Notice: Subject to any disclaimer, the term of this patent is extended or adjusted under 35 U.S.C. 154(b) by 773 days.

(21) Appl. No.: 13/109,339

(22) Filed: May 17, 2011

(65) Prior Publication Data

US 2012/0292046 A1 Nov. 22, 2012

(51) Int. Cl.
*E21B 33/05* (2006.01)
*E21B 23/00* (2006.01)
*E21B 33/068* (2006.01)

(52) U.S. Cl.
CPC ..... *E21B 33/05* (2013.01); *E21B 33/068* (2013.01)
USPC ..... 166/70; 166/378

(58) Field of Classification Search
CPC ..... E21B 33/14; E21B 33/05; E21B 33/068; E21B 33/16; E21B 16/00; E21B 19/16; E21B 47/04; E21B 47/09
USPC ..... 166/70, 378, 177.3, 177.4, 64, 85.1
See application file for complete search history.

(56) References Cited

U.S. PATENT DOCUMENTS

| | | | | |
|---|---|---|---|---|
| 2,664,163 | A | 12/1953 | Schnitter | |
| 4,722,389 | A * | 2/1988 | Arnold | 166/70 |
| 4,917,184 | A | 4/1990 | Freeman | |
| 4,928,520 | A * | 5/1990 | Barrington | 73/152.57 |
| 5,095,988 | A | 3/1992 | Bode | |
| 5,950,724 | A | 9/1999 | Giebeler | |
| 6,634,423 | B2 | 10/2003 | Giebeler | |
| 6,672,384 | B2 | 1/2004 | Pedersen | |
| 6,904,970 | B2 * | 6/2005 | Simson | 166/291 |
| 7,055,611 | B2 | 6/2006 | Pedersen | |
| 7,325,610 | B2 | 2/2008 | Giroux | |
| 7,510,006 | B2 | 3/2009 | Juhasz | |
| 7,654,325 | B2 | 2/2010 | Giroux | |
| 8,082,982 | B2 * | 12/2011 | Mosing et al. | 166/177.4 |
| 8,302,698 | B2 * | 11/2012 | Giem | 166/386 |
| 2004/0060697 | A1 * | 4/2004 | Tilton et al. | 166/253.1 |
| 2004/0089455 | A1 * | 5/2004 | Richardson | 166/386 |
| 2005/0000691 | A1 * | 1/2005 | Giroux et al. | 166/291 |

(Continued)

FOREIGN PATENT DOCUMENTS

| | | | |
|---|---|---|---|
| CA | 2114176 | A1 | 9/1994 |
| EP | 1340882 | A2 | 9/2003 |
| WO | 2010049664 | A1 | 5/2010 |

*Primary Examiner* — Kenneth L Thompson
*Assistant Examiner* — Michael Wills, III
(74) *Attorney, Agent, or Firm* — Field LLP

(57) ABSTRACT

A top drive-pumpable cement head is provided for cementing a casing into a wellbore comprising a top sub portion with a top drive connection connectable to a top drive shaft to receive cement and impart translational and rotational forces to the casing simultaneously during cementing, and a ball launching assembly for housing and launching one or more launching balls. A bottom sub portion comprises a casing sleeve for housing one or more hollow wiper plugs and a tattle tale wire. The cement head also comprises a hammer union. The ball launching assembly is pre-loadable with the launching balls, the bottom sub is pre-loadable with the one or more hollow wiper plugs and a tattle tale wire and the top sub and the bottom sub are connectable via the hammer union for storage, prior to cementing operations. A method is also provided for assembling a cement head for completing a casing in a wellbore.

25 Claims, 6 Drawing Sheets

(56) References Cited

U.S. PATENT DOCUMENTS

2008/0099196 A1* 5/2008 Latiolais et al. ..... 166/153
2010/0200222 A1 8/2010 Robichaux
2011/0139435 A1* 6/2011 Latiolais et al. ..... 166/153

* cited by examiner

CEMENT HEAD

TECHNICAL FIELD

This invention relates to a cement head device for completing downhole wellbores.

BACKGROUND OF THE INVENTION

In oil and gas wells drilled throughout the world, a well bore liner, or casing is placed inside the open wellbore to maintain wellbore stability and to control formation pressures. In many of these wells, an intermediate casing is installed and cemented into place. After the intermediate casing is installed, drilling can be continued through this casing to a deeper depth. Formations outside the intermediate casing are thus isolated, which helps to eliminate well bore cave in and to contain formation pressures and fluids. The cementing of the intermediate casing to the formation is critical to obtain these goals. If the cement bond is poor, formation pressures can migrate through the inadequate cement to the surface, resulting in an uncontrollable well bore.

To cement the casing into drilled well bore, a pre-calculated volume of cement is pumped down the inside of the casing and up the outside of the casing, to surface. Once the cement is pumped inside the casing, a drillable rubber wiper plug or wiper plug, is installed inside the casing on top of the cement slurry. Water is then pumped inside the casing to push the wiper plug downwards and thereby displace the cement slurry from the inside of the casing to the outside of the casing. Once the casing volume is filled with water and the wiper plug has reached the bottom of the casing, the cement fills the cavity between the casing and the drilled well bore and reaches the surface. Pumping pressures will increase when the plug reaches the bottom of the casing, informing personnel that the cement is in place and the plug has reached the bottom of the casing. Once adequate time has expired for cement curing, the plug can be drilled out and drilling to deeper depths can continue.

In order to rotate the casing or change casing elevations while cementing, a cementing attachment, called a cement head is placed at the top of the casing. The cement head contains hoses and piping to transfer the cement and water from pumps to the inside of the casing. It also contains valves to launch the wiper plug down inside the casing and bearing assemblies to isolate the movement of the hoses and piping in order to rotate the casing.

Most cement heads are cumbersome and only some offer rotational movement of the casing while most will allow only vertical movement, but never both reciprocation and rotation. While cementing under high pressures, piping connections on cement heads may vibrate loose and the cementing job must be temporarily stopped to tighten fittings. Hoses and piping must be reasonably lengthy in order to provide sufficient allowance for the casing to be reciprocated up and down within the rig derrick, causing hazards on the rig floor.

The typical cement head has two valves located above and below the wiper plug, each connected to a manifold and then to one common pumping line. The cement line and cement valve are located below the wiper plug, while the water line and water valve are located above the wiper plug. While pumping the cement slurry, the cement valve is open and the water valve is closed so that cement bypasses the plug to place cement inside the casing. Once the proper volume of cement is pumped, the cement valve is then closed and the water valve is opened. The pumped water above the plug, launches the plug and continues to displace the volume of cement.

While most rigs have top drives, rotation of the casing can be achieved by connecting the drive to the top of the cement head. Those rigs that rotate using a rotary table are unable to rotate and reciprocate the casing at the same time, unlike the top drive rig. Since most cement heads have lines attached to them, rotation is impossible without the use of bearings to keep the lines stationary. With the use of these bearings, rotation of the casing is not achievable with the top drive, but only with the rotary table. When the rotary table is being used, reciprocate of the casing is not possible.

On some vertically drilled wells and on most horizontally drilled wells, the casing does not stay centered within the drilled well bore while placing cement slurries. On horizontal wells, the casing does not hang pendulum to the well bore like a vertical well, and stabilization often cannot withstand the weight of the casing from contacting the horizontal well bore. In these situations, the cement will channel through the larger cavity between the casing and well bore, placing cement in only some areas of the wellbore cavity. In many cases, lack of movement of the casing causes the casing to stick to the wellbore walls before or during the cementing operation. Allowing the casing to be rotated and reciprocated at the same time will allow maximum cement coverage around the casing and will avoid channeling.

Furthermore, there is a need for a cement head tool that is simple and quick to load or pre-load and assemble. Importantly, there is a need to be able to pre-load and pre-assemble a cement head to provide a quick transition in the field to cementing operations.

SUMMARY OF INVENTION

A top drive-pumpable cement head is provided for cementing a casing into a wellbore. The cement head comprises a top sub portion with a hollow mandrel, a top drive connection connectable to a top drive shaft to receive cement and impart translational and rotational forces to the casing simultaneously during cementing, a quick attach union and a ball launching assembly threaded into the mandrel for housing and launching one or more launching balls. A bottom sub portion comprises a casing sleeve for housing a one or more hollow wiper plugs, a quick connect union and a plug location monitor threaded into the casing sleeve having a tattle tale wire and a seal packing assembly. Finally, a hammer union comprising an upper female union having one or more torque blocks a hammer union comprising an upper female union having one or more torque blocks and one or more drive pins, and a lower male union having one or more corresponding torque block slots and one or more corresponding drive pin pockets. The ball launching assembly is pre-loadable with the launching balls, the bottom sub is pre-loadable with a one or more hollow wiper plugs and a tattle tale wire and the top sub and the bottom sub are connectable via the hammer union for storage, prior to cementing operations.

A method is also provided for assembling a cement head for completing a casing in a wellbore. The method comprises pre-loading a ball launcher assembly, threaded on a top sub portion of the cement head, with one or more launching balls and connecting the top sub portion to an upper female union of a hammer union. Next, a bottom sub portion of the cement head is pre-loaded with one or more hollow wiper plugs and connected to a lower male union of a hammer union. Finally, the upper female union is connected to the lower make union and the hammer union is hand rotated to tighten.

BRIEF DESCRIPTION OF THE DRAWINGS

The present invention will now be described in greater detail, with reference to the following drawings, in which.

DETAILED DESCRIPTION OF THE INVENTION

Figure 1:
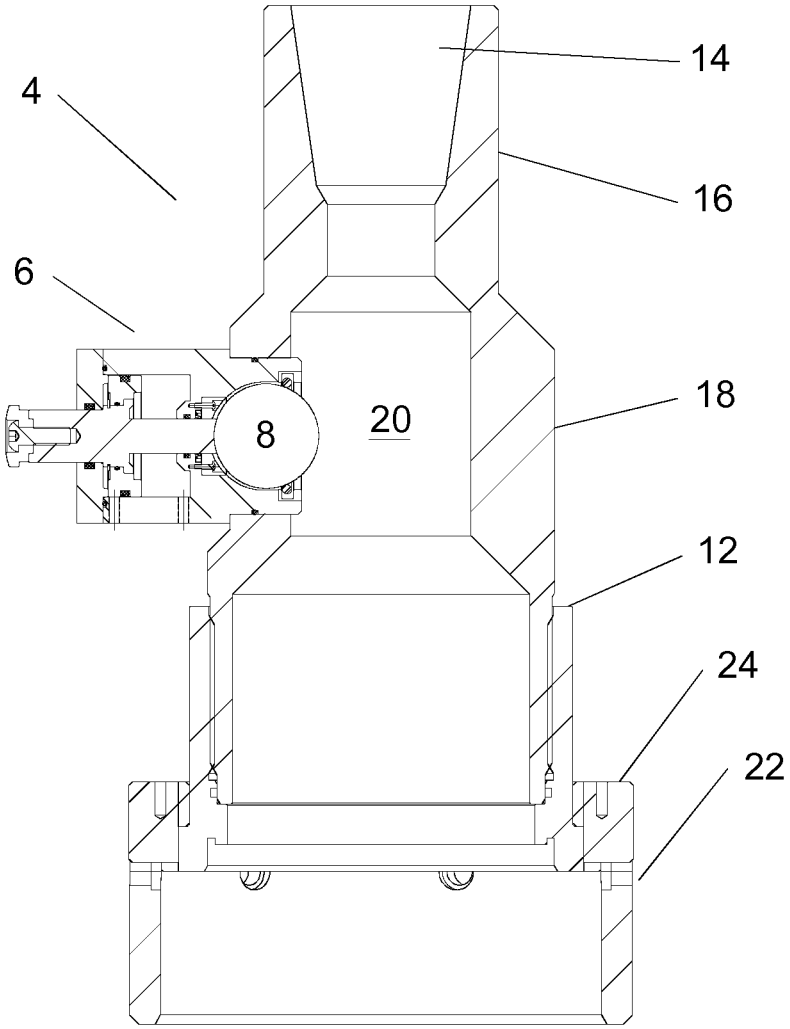
FIG. 1 is an elevation view of one embodiment of the top sub portion of the present cement head.
Figure 2:
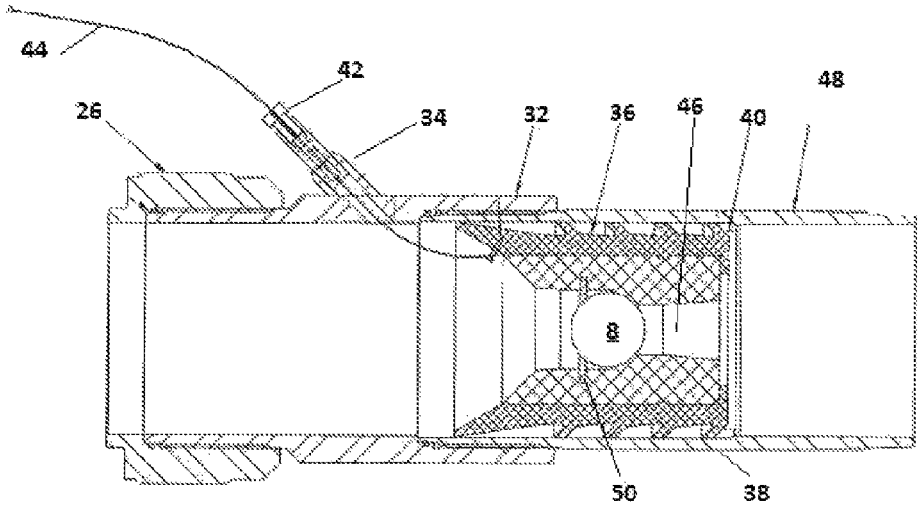
FIG. 2 is an elevation view of one embodiment of the bottom sub portion of the present cement head.
Figure 3:
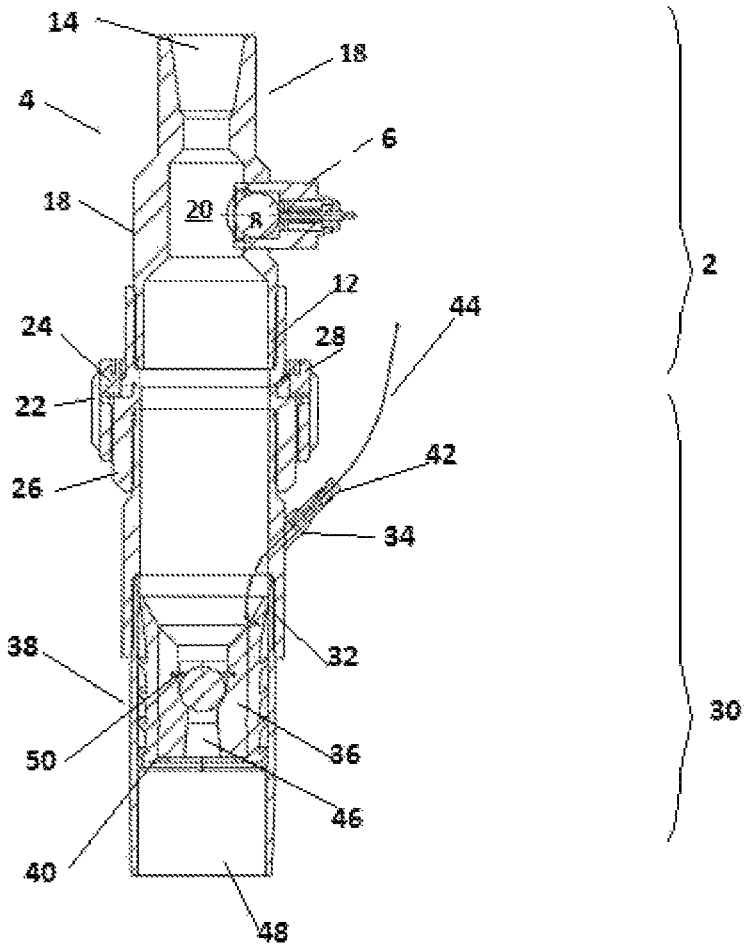
FIG. 3 is an elevation view of one embodiment of present assembled cement head.

The present invention relates to a quickly rigged up cement head tool for using in completing a variety of wellbores. The tool facilitates both rotational and reciprocating motion of the cement head simultaneously during cementing operations. The present device is top drive-pumpable, and does not require cement inlet manifold lines that can become entangled with rotation of the tool.

With reference to FIGS. 1 to 3 and 5, the present tool is assembled in two parts, a top-sub component 2 and a bottom sub component 30. The top sub component 2 comprises of a mandrel 4, launching valve 6, one or more launching balls 8, an optional remote launcher 10 and quick attach union 12.

The bottom sub component 30 and top sub component 2 are separatable from each other to allow ease of loading parts into each components. The system is also easily dismantled in the event of a wiper plug failure or failure of other parts of the cement head. The top and bottom sub components can be disconnected on sight and replacement parts loaded, while minimizing stoppage time in pumping operations.

The mandrel 4 has a top drive connection 14 located in its upper portion 16, to connect to the rig equipment for pumping and lifting purposes. The mandrel top drive connection 14 is machined to various connections and lengths to suit the rig. The upper portion 16 of the mandrel 4 is smaller in outside diameter than the lower portion 18. The lower portion 18 is larger in diameter to house the launching valve 6, ball 8 and the remote launcher 10. The lower portion 18 preferably has an average outside diameter of 10", whereas the preferred average outside diameter of the upper portion 16 is about 6.5". The mandrel 4 can be preferably used for various casing diameters. The mandrel 4 has an inside bore 20 and the lower portion 18 is drilled through with a side port to the inside bore 20 of the mandrel 4 through the side of the mandrel 4. The side port preferably has a threaded connection to connect the launching valve 6 to the mandrel 4. The lower portion 18 of the mandrel 4 is also threaded to mate to a female portion of a quick attach hammer union.

The threaded launching valve assembly is inserted into the threaded side port 22 and tightened. The launching valve 6 is equipped with seals to protect against pressure and fluid leaks. The launching valve 6 also houses the launching ball 8, which is typically 3" in diameter or smaller. A valve handle connected to a valve stem is used to launch the launching ball 8. When the valve stem of the launching valve 6 is opened, the ball 8 remains inside the valve assembly. When a valve handle attached to the launching valve 6 is closed, the valve stem forces the launching ball 8 out of the launching valve 6 and into the mandrel 4, above a wiper plug. The valve handle is designed to be removable from the launch valve 6 and only to be installed when ball launching is required. The ball housing is preferably designed with a split retainer ring to keep debris and cement from contaminating the launching valve assembly and also to contain the ball within its housing. The launching valve assembly is preferably designed with seals to withstand maximum pumping pressures and can therefore be activated under pumping pressures. The threaded valve stem is connected to the back end of the launching valve assembly. This stem is designed in a manner to allow the movement of the ball housing, without causing movement in the valve stem. The valve stem has only rotational movement. This decreases the total length of the launching valve assembly that protrudes outside of the mandrel 4. Since the mandrel 4 is allowed to rotate, the launching valve assembly length is preferably kept as small as possible.

In the case of a two stage cement job, the launching valve assembly 6 contains two launching balls 8, and the ability to launch each ball separately.

The launching ball diameter can range in size depending on its application. Preferably, the ball 8 is 3" in diameter and manufactured from a hard plastic such as Ertalyte™. The material chosen for the ball must be rig bit drillable, and can withstand high pressures and corrosion from chemicals found in drilling fluids and cements. The launching ball 8 is launched in order to activate the movement of the wiper plug. The purpose of the ball is to seal off an open hole, through bore, machined on the inside of the wiper plug. In the case of a two stage cement job, the first ball launched would be a 2" diameter ball, and the last ball launched would be a 3" diameter ball.

Figure 5:
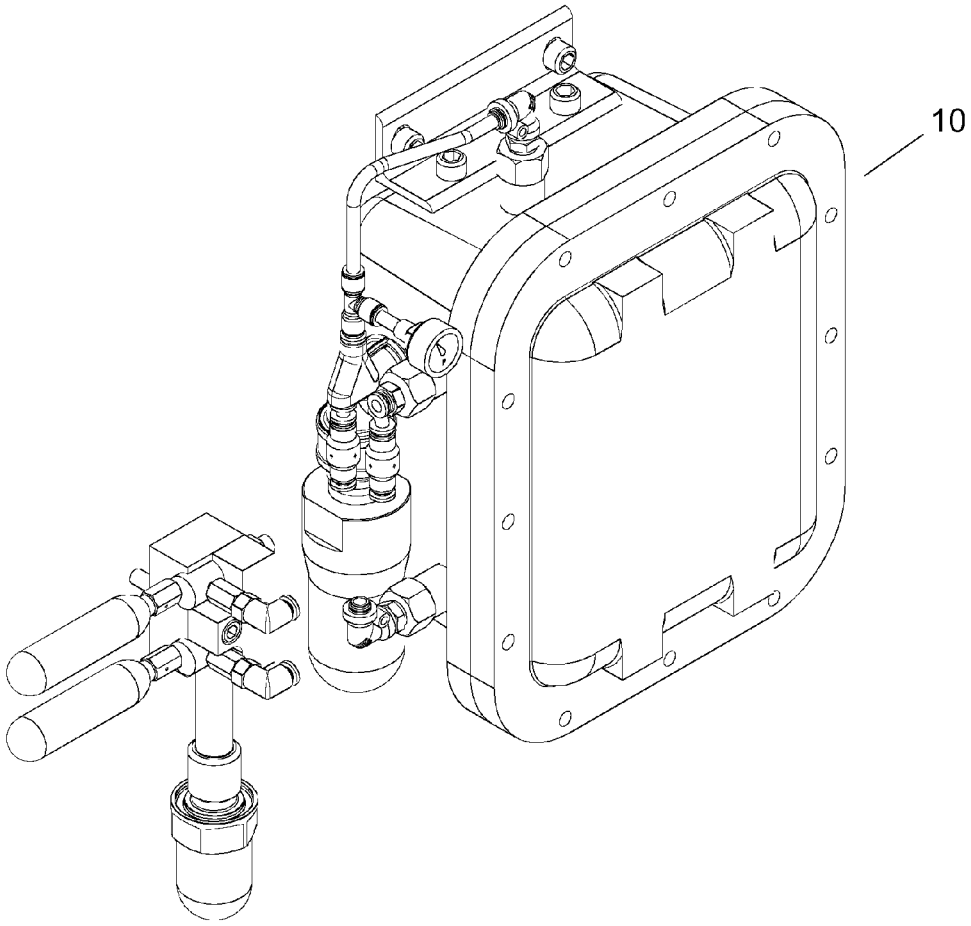
FIG. 5 is a front perspective view of one embodiment of a remote ball launcher of the present invention.

In an optional embodiment, illustrated in FIG. 5, a remote launcher 10 is attached to the outside of the mandrel 4 and the launching valve 6, to allow ball launching without interrupting the cementing job or stopping movements of the casing, regardless of the cement heads position to the rig floor.

A hammer union 22 is provided for connecting the top sub 2 to the bottom sub. The hammer union 22 comprises an upper, female union 24 having a series of drive pins and a lower, male union 26 having a corresponding series of mating pin pockets. When connecting the upper union 24 with the lower union 26, seals provide pressure and leak protection and a series of torque blocks 28 engage to protect the hammer union 22 from loosening or over-tightening during cementing and rotation of the casing.

The bottom sub 30 comprises a quick connect union 32 for mating with the quick attach union 12 on the top sub 2, a plug location monitor 34, preferably in the form of a tattle tale line, one or more wiper plugs 36, and a casing sleeve 38 with a stop ring 40.

The quick connect union 32 is a male threaded end that connects to the female quick attach union 12 of the top sub 2 of the cement head. The quick connect union 32 is also preferably threaded on at its bottom end to connect to the plug locator monitor 34.

The plug locator monitor 34 consists of an upper pin connection and a lower box connection. The pin connection attaches to the quick connect union 34 while the box connection attaches to the casing sleeve 38. The plug locator monitor 34 has a threaded port on its outside diameter and a through bore to the inside of the bottom sub. The threaded port is preferably at a 45 degree angle to the bottom sub.

A seal packing assembly 42 is then threaded into this port. The seal packing assembly 42 holds a combination of seals with a jam packing nut. The inside bore of the seals accommodates a tattle tale wire 44, which is attached to the wiper plug 36 by means of a shear screw, which is located inside the casing sleeve 38. The other end of the tattle tale wire 44 lies outside the seal packing assembly 42 and acts as a visual monitor.

The casing sleeve 38 attaches to the bottom of the plug locator monitor 34. The bottom of the casing sleeve 38 contain a casing connection 48 that is to be cemented. The casing sleeve 38 is preferably interchangeable depending on thread style, casing weights, grades and sizes. The casing sleeve 38 can also preferably house a removable stop ring 40. The purpose of the stop ring 40 is to hold the one or more wiper plugs 36 in position before it is deployed by the launching ball 8.

One or more wiper plugs 36 are installed into the casing sleeve 38 from a top end of the sleeve and rests on the stopper ring 40. The wiper plugs 36 can be installed by hand and are held in place in part by friction fit. No shear pins are required to hold the wiper plug in place.

The tattle tale wire 44 is then attached to the wiper plug 36 by a shear screw, before the hammer union 22 is connected. The wiper plugs 36 are preferably designed with a tapered through bore 46. The through bore 46 allows for the passage of cementing fluids during cementing. When the one or more launching balls 8 are deployed, they seat inside the tapered bore and act to seal fluids from passing through the one or more wiper plugs 36. The wiper plug 36 is preferably made of drillable rubbers and plastics. Outside fins formed on the outside of the wiper plug 36 are designed to seal to an inside wall of the casing sleeve 38 when induced with pressure from below the wiper plug 36. The fins will not hold or seal with any pressure from above the wiper plug 36. This design allows movement of the wiper plug 36 downward through the casing and allows fluids above or below the plug to be contained. Pressure above the wiper plug 36 forces the fins to open and thereby seal against an inside wall of the casing.

The wiper plug 36 is further fitted with a retainer ring 50 inside its bore through hole, just above the ball seating area. This retainer ring 50 has an inside diameter slightly smaller than the launching ball 8. When the launching ball 8 is launched, it abuts the retainer ring 50, and with minor pressure, will pass through the retainer ring 50 to seat on the seating area. If pumping of the wiper plug 36 down the casing is stopped for any reason the retainer ring 50 acts to hold the launching ball 8 from floating out of the wiper plug 8 from either buoyancy or hydrostatic pressures. When pumping is restarted, the launching ball 8 remains in the seated area and prevents fluid from leaking through the wiper plug 36. The retainer ring 50 also holds the launching ball 8 in the wiper plug 36 after the cement job is completed. When drilling out the wiper plug 36 and launching ball 8, the launching ball 8 can thus be drilled at the same time as the wiper plug 36, and not separately. The retainer ring 50 is preferably made of rubber or other suitable elastomeric materials well known in the art.

The tapered through bore 46 is preferably slightly larger than the diameter of the launching ball 8 at its top end, to allow the launch ball 8 to fall within the hole until it reaches a seating portion of the through bore 46, which is machined to a size smaller then the launching ball 8. Once the launching ball 8 reaches the seating position, it seals the through bore 46 and prevents the flow of fluids through the wiper plug 36. Pressure above the seated launching ball 8 causes the entire wiper plug 36 and launching ball 8 to travel past the stop ring 40 and down into the casing.

In the case of a two stage cement job, two wiper plugs are used. For example, in this type of cementing, two volumes of cement can be pumped with a column of water between them. The two cement columns are kept separated by the use of plugs. A lower plug (not shown) is machined to receive and be sealed by a 2" diameter launching ball, while the second, upper plug is machined for a 3" diameter launching ball. The first 2" diameter launching ball passes through the upper plug and seals the lower plug, which can then be pumped down the casing. The second 3" diameter launching ball is then launched to seal to the upper plug and is also then pumped down through the casing.

Figure 4:
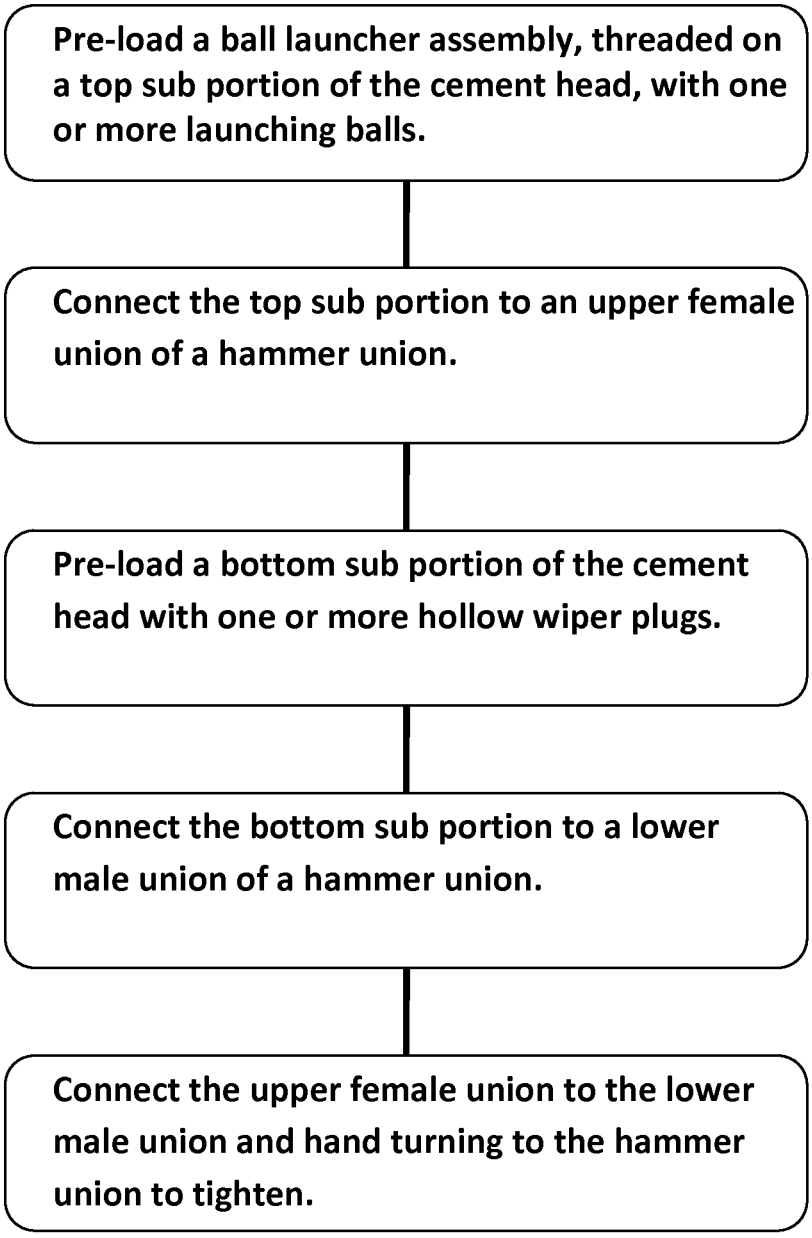
FIG. 4 is a schematic diagram illustrating one embodiment of the method of the present invention.

Assembly of the present cement head is generally illustrated in the schematic diagram of FIG. 4.

The top sub 2 is connected to the rig's top drive and the bottom sub 30 is connected to the casing to be cemented. The top sub 2 and a bottom sub 30 are then connected together with the quick attach hammer union 22.

The cement head can be manufactured from a variety of materials. Preferably, the cement head is manufactured from 4145 H-MOD alloy steel. The top sub 2 of the cement head is preferably installed to the top drive using a top API box connection, although other suitable connections known in the art are also possible. Most preferably the box connection is a 4½" I.F. box connection. The fish neck design of the APO box connection will be of sufficient length to allow the top drive grapple to engage to the box connection to provide proper torque. Once the top drive connection is complete, the ball launching assembly can be installed with, for example, a pipe wrench. The ball launching assembly may also be installed prior to connection of the top sub 2 with the top drive, as long as it does not disrupt the makeup of the top drive connection.

After each cement job, the top sub 2 will require a new launching ball 8, as this is a consumable part. The launch ball 8 can be installed in two different manners. The ball launching assembly can be unthreaded from the top sub and the launching ball 8 inserted into the launching valve 6. Then the ball launching assembly is installed back onto the top sub 2.

Alternately, installation of the launching ball 8 into the ball launching valve 6 can be done without removal of the ball launching assembly from the top sub 2.

In either case, the ball launching valve 6 must first be opened to accept the new launching ball 8. After the launching ball 8 has been dropped, the launch valve stem is fully extended, and will not accept a new ball until the valve stem has been retracted. When using a manual launcher, the launching handle is rotated until it stops, to retract the valve stem fully and launch the launch ball 8. The launching handle is connected only when ball launching is required. A counter clockwise rotation of the launching handle will launch the ball 8.

When using the remote launcher 10, the valve stem is pulled back and locked into place to retract the valve stem.

Figure 6:
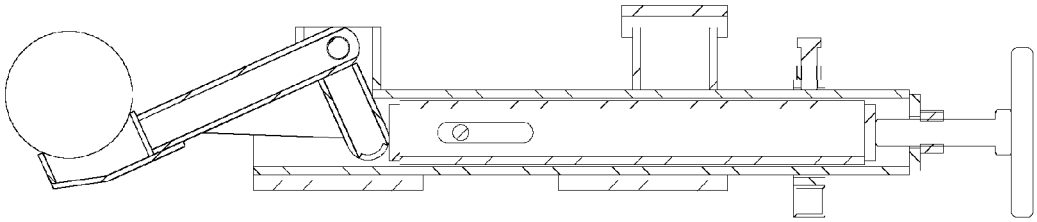
FIG. 6 is an elevation view of one embodiment of a ball loader of the present invention.

An optional ball loader tool shown in FIG. 6 can also be used to insert the launching ball 8 into the launching valve 6. The tool, with the launching ball 8 loaded on it is positioned inside the top sub 2 so the launching ball 8 abuts the inside of the launching valve 6. A handle of the ball loader tool is then depressed to squeeze the launching ball 8 past the split retainer ring. The launching ball 8 is now loaded and the loader tool can be removed.

Before the bottom sub 30 is installed to the casing, it is loaded with the wiper plug 36 and the tattle tale wire 44 is screwed to the wiper plug 36. The seal packing assembly 42 acts to seal the tattle tale wire 44 from leaking. A jam nut on the outside of the seal packing assembly can be adjusted for leakage as well as tightness to the tattle tale wire 44. The jam nut should be tight enough to prevent leakage while also allowing movement of the tattle tale wire 44, to prevent premature shearing of the shear screw that holds the tattle tale wire 44 to the wiper plug 36. When installing the tattle tale wire 44, it should be possible to pull the tattle tale wire 44 through the packing assembly by hand. The seal packing assembly 42 is preferably greased after every cement job. If the tattle tale wire 44 has any aggressive bends or kinks, the wire should be replaced.

This operation can be completed before installation of the bottom sub 30 to the casing and the thus assembled bottom sub 30 can then be stored with its union end facing up. After each cement job, a new wiper plug 2 is required to be installed inside the bottom sub. This wiper plug 2 is therefore a consumable part.

To connect the top sub 2 and bottom sub 30 of the cement head together, the bottom sub 30 is placed upright on a level area. The top sub 2 is then lifted and positioned above the bottom sub 30 and the female hammer union 24 is aligned to expose the drive pins on the female hammer union 24. The drive pins engage into the drive pin pockets on the male union 26 on the bottom sub 30.

As the top sub 2 is lowered onto the bottom sub 30 with the drive pins lined up to the drive pin pockets until the seal faces of the top and bottom subs contact each other. If the seal face contact is not visible, a slight turn of the top sub 2 until the drive pins fall into their respected drive pin pockets will allow the seal faces to meet. The female hammer union 24 is then lowered and threaded by rotation until the connection is hand tight. Further tightening can be achieved, for example by use of a hammer, as well as creating an alignment of the slots for the installation of the torque blocks 28. Preferably, three different alignment positions are possible for the slots. Once this alignment is achieved, the torque blocks 28 can be removed from their holders and installed into the slots. The torque blocks 28 should slide down and stop when properly installed. Most preferably two torque blocks are installed 180° apart from one another.

The purpose of the torque blocks 28 are to protect the hammer union 22 from making up at a higher torque, while the casing is being rotated during the cement job. If the hammer union is subject to high torque, it may not be serviceable by hand and could require breakout equipment. By ensuring that the hammer union 22 is serviceable by hand, the hammer union 22 can be opened for inspection if there is ever a problem with the wiper plug. Also, after cementing, the entire cement head can be removed from the casing connection 48, and serviced at a later time, without requiring further time or breakout equipment during critical time sensitive cementing jobs.

In the case of slant rig operations, it is often difficult to thread a complete cement head with a top drive onto a well casing and without damaging the threads. In the present invention, the bottom sub 30 is installed to the casing in the slips and then torqued to predetermined settings. Next the top sub 2 is installed to the top drive by lowering the top drive with the top sub 2 attached until the female union 24 end meets the male union 26 end. In this arrangement, there is less chance of damage to critical threaded materials. The hammer union 22 is tightened by hand and then by hammer until the torque block slots are lined up. Torque blocks 28, preferably two of them 180° apart, are then installed in the torque block slots.

On a conventional rig, the cement head can be previously made up with hammer union 22 tightened and torque blocks 28 installed. The cement head can then be lifted as one piece, installed to the top drive and then to the casing. A cement pumping unit is then connected directly to the top of the top drive by a Kelly hose or other well known means. By this arrangement, there is no need for excess lines, chick stands or valve manifolds as would be required in conventional arrangements.

The proper amount of cement is pumped. Once this volume is pumped, the ball is launched, either remotely or manually by turning a valve handle on the ball launching assembly. Once the launching ball 8 reaches its seated position within the wiper plug 36, pumping pressure causes the wiper plug 36 to travel downward, past the stop ring 40. Once the wiper plug 36 starts to move, it will pull the tattle tale wire 44 with it, until the tattle tale wire 44 has traveled its entire length and comes to a stop. At this point, further downward motion of the wiper plug 36 causes the shear screw to shear from the wiper plug 36. The visual shortening length of the tattle tale wire 44 outside the cement head indicates that the wiper plug 36 has been pumped. Movement of the tattle tale wire 44 is monitored from the time that the launching ball 8 is launched, to ensure that internal pressures does not force the tattle tale wire back out of the seal packing assembly 42 after the wiper plug 36 is pumped. In the present invention, the cement wiper plugs 36 is activated without the need for cumbersome pumping lines and valves and without having to stop the movement of the casing to activate the valves manually. This in turn allows continuous flow of cement through the well bore around the casing, creating a solid cement bond.

The cement head can be serviced on rig location between cement jobs. The consumable parts in each cementing job, that is a wiper plug, launching ball and a tattle tale screw, can all be replaced at this time. After each cement job, the cement head can be disassembled as described above to prepare for service.

At times when the cement head is serviced in the field, the cement head can be stored in an optionally supplied container when not in use, or during transport.

In the foregoing specification, the invention has been described with a specific embodiment thereof; however, it will be evident that various modifications and changes may be made thereto without departing from the broader spirit and scope of the invention.

Having thus described the invention, what is claimed as new and secured by Letters Patent is:

1. A top drive pumpable cement head for cementing a casing into a wellbore, comprising:

a. a top sub portion comprising a hollow mandrel, a top drive connection connectable to a top drive shaft to receive cement and impart translational and rotational forces to the casing simultaneously during cementing, a quick attach union and a ball launching assembly threaded into the mandrel for housing and launching one or more launching balls;

b. a bottom sub portion comprising a casing sleeve for housing one or more one or more hollow wiper plugs, a quick connect union and a plug location monitor threaded into the casing sleeve having a tattle tale wire and a seal packing assembly; and c. a hammer union comprising an upper female union having one or more torque blocks and one or more drive pins, and a lower male union having one or more corresponding torque block slots and one or more corresponding drive pin pockets, wherein the ball launching assembly is pre-loadable with the launching balls, the bottom sub is pre-loadable with one or more hollow wiper plugs and the tattle tale wire and wherein the top sub and the bottom sub are connectable via the hammer union for storage, prior to cementing operations.

2. The cement head of claim 1, wherein the ball launching assembly can be preloaded by unthreading the ball launching assembly from the mandrel.

3. The cement head of claim 1, wherein the ball launching assembly can be preloaded by opening the ball launching assembly without removing the ball launching assembly from the mandrel.

4. The cement head of claim 1, further comprising a ball loader tool with a handle for loading the one or more launching balls into the ball launching assembly.

5. The cement head of claim 1, further comprising a remote ball launcher connected to the ball launching assembly.

6. The cement head of claim 1, wherein the one or more launching balls are launched manually by means of a valve handle removably connected to the ball launching assembly.

7. The cement head of claim 1, wherein the hollow mandrel receives cement from the top drive during cementing and allows passage of the launching ball once cement has been pumped.

8. The cement head of claim 1, wherein the one or more hollow wiper plugs each comprise a tapered through bore that is larger than the launching ball at a top end, to allow the launch ball to fall through the tapered through bore to reach a seating position at a smaller bottom end of the tapered through bore, where the launching ball seals the through bore and prevents flow of fluids through the hollow wiper plug.

9. The cement head of claim 8, wherein the one or more hollow wiper plugs each comprise a retainer ring in the seating position of the smaller bottom end of the tapered though bore that holds the launching ball inside the hollow wiper plug.

10. The cement head of claim 1, wherein the one or more hollow wiper plugs comprise one or more outer fins that seal to an inside wall of the casing when induced by pressures from above the hollow wiper plug, but not by pressures from below the hollow wiper plug.

11. The cement head of claim 1, wherein the casing sleeve further comprises on or more removable stop rings to prevent movement of the one or more wiper plugs downwards through the casing during cement flow.

12. The cement head of claim 1, wherein the one or more hollow wiper plugs are loadable into the casing sleeve by hand.

13. The cement head of claim 1, wherein the tattle tale wire is affixed to the wiper plug by means of a shear screw and passes through the seal packing assembly to outside of the bottom sub.

14. The cement head of claim 1, wherein the plug locator monitor is threaded into the casing sleeve at a 45 degree angle to the bottom sub.

15. The cement head of claim 1, wherein the cement head is manufactured from 4145 H-MOD alloy steel.

16. A method assembling a cement head for completing a casing in a wellbore, comprising the steps of:

a. pre-loading a ball launcher assembly, threaded on a top sub portion of the cement head, with one or more launching balls;
b. connecting the top sub portion to an upper female union of a hammer union;
c. pre-loading a bottom sub portion of the cement head with one or more hollow wiper plugs;
d. connecting the bottom sub portion to a lower male union of a hammer union;
e. connecting the upper female union to the lower male union and hand turning to the hammer union to tighten;
f. lifting the assembled cement head as one piece;
g. installing the cement head to a top drive; and
h. installing the cement head on the casing.

17. The method of claim 16, wherein the top sub portion is pre-loaded with the one or more launching balls and stored prior to assembly.

18. The method of claim 16, wherein the top sub portion is connected to a top drive prior to being pre-loaded with the one or more launching balls.

19. The method of claim 16, wherein the ball launching assembly is unthreaded from the top sub to pre-load the one or more launching balls.

20. The method of claim 16, wherein the one or more launching balls are preloaded into the ball launching assembly by:

a. opening a ball launching valve on the ball launching assembly to accept the one or more launching balls; and
b. fully extending a launch valve stem on the launching valve to accommodate the one or more launching valves in the launching valve.

21. The method of claim 16, wherein the top sub portion is connected to a top drive prior to being connected to the bottom sub portion.

22. The method of claim 16, wherein the bottom sub portion is pre-loaded with the one or more hollow wiper plugs and stored prior to assembly.

23. The method of claim 16, further comprising:

a. removably affixing a tattle tale wire to an inside surface of the one or more hollow wiper plugs after the one or more hollow wiper plugs has been pre-loaded into the bottom sub portion but before the bottom sub is connected to the casing, wherein the tattle tale wire passes through a seal packing assembly, threaded onto the bottom sub portion, and out to the outside of the cement head.

24. The method of claim 16, wherein the bottom sub portion is connected to the casing prior to being connected to the top sub portion.

25. The method of claim 16, wherein connecting the top sub portion to the bottom sub portion comprises:

a. placing the bottom sub portion upright on a level area;
b. lifting and positioning the top sub portion above the bottom sub portion;
c. aligning the upper female hammer union with the lower male union;
d. lowering the top sub portion onto the bottom sub portion such that one or more drive pins on the upper female union engage with one or more corresponding drive pin pockets on the lower male union;
e. rotating the hammer union by hand to tighten; and
f. installing one or more torque blocks held in the upper female union into one or more corresponding slots of the lower male union.

* * * * *